United States Patent [19]

Parker

[11] 4,335,782

[45] Jun. 22, 1982

[54] HEAT EXCHANGER METHOD

[75] Inventor: Kenneth O. Parker, Rolling Hills Estates, Calif.

[73] Assignee: The Garrett Corporation, Los Angeles, Calif.

[21] Appl. No.: 725,612

[22] Filed: Sep. 22, 1976

Related U.S. Application Data

[62] Division of Ser. No. 484,517, Jul. 1, 1974, abandoned.

[51] Int. Cl.[3] ..... F28C 13/06

[52] U.S. Cl. ..... 165/1; 165/166

[58] Field of Search ..... 165/157, 166, 142, 174, 165/128, 130; 138/37; 29/157.4

[56] References Cited

U.S. PATENT DOCUMENTS

| | | | |
|---|---|---|---|
| 1,313,518 | 8/1919 | Clark | 165/174 |
| 2,261,596 | 11/1941 | Stroobants | 165/96 |
| 2,511,084 | 6/1950 | Shaw | 165/166 |
| 2,617,634 | 11/1952 | Jendrassik | 165/166 X |
| 3,229,761 | 1/1966 | Ware | 165/174 |
| 3,605,882 | 9/1971 | Smith et al. | 29/157.4 |

FOREIGN PATENT DOCUMENTS

| | | | |
|---|---|---|---|
| 941012 | 6/1948 | France | 138/37 |

*Primary Examiner*—Samuel Scott
*Assistant Examiner*—Theophil W. Streule, Jr.
*Attorney, Agent, or Firm*—Alfons Valukonis; Joel D. Talcott; Albert J. Miller

[57] ABSTRACT

In the apparatus of the present invention, air flow control inserts are disposed within the formed tube air outlet manifolds of a heat exchanger of the counterflow type wherein the manifolds have openings communicating with air passages of the heat exchanger core. Each insert is generally tubular in shape, having an intermediate cylindrical tube portion, and larger diameter end portions, which are substantially equal to the diameter of an outlet manifold. Each intermediate insert portion is initially provided with a plurality of peripheral, longitudinally equally spaced slots, equal in number to the number of openings in a manifold, and of such circumferential lengths as to subtend angles substantially equal to the angles subtended by the manifold openings. Tube material adjacent the slots is then urged inwardly of the tube to form apertures and adjacent louvers. The tube inserts are positioned within the air outlet manifolds with their longitudinal axes coinciding with the longitudinal axes of the manifolds to define air chambers therebetween, while the louvers are each disposed opposite a manifold opening. The louvers gradually direct air flow from the air chambers into the apertures to substantially reduce the pressure drop the air would ordinarily experience merely abruptly dumping into the manifolds from the openings. The size of each aperture is adjustable, and determined by the extent to which each adjacent louver is inwardly urged within the insert. Adjustment of the individual aperture sizes with the louvers regulates air flow through the apertures and adjacent manifold openings, and can be utilized to provide for a more uniform air flow distribution throughout the heat exchanger core air passages. According to another aspect of the invention, inserts are provided which are positionable within the air outlet manifolds, and provide for rapid movement of air flowing from the manifold openings in a circular direction within, and then axially out of the manifolds to distribute temperature more uniformly throughout the manifolds, thus reducing core thermal stresses.

1 Claim, 10 Drawing Figures

HEAT EXCHANGER METHOD

This is a divisional of application Ser. No. 484,517 filed July 1, 1974, now abandoned.

BACKGROUND OF THE INVENTION

This invention relates generally to heat exchanger method and apparatus, and more particularly to heat exchanger method and apparatus of the counterflow, formed tube air inlet and outlet manifold type, with improved outlet manifold air flow control.

In prior art heat exchangers of the above counterflow, formed tube type, as cooling air flows from the air flow passages in the heat exchanger core and into the air outlet manifolds, it suffers a sudden change of direction, and pressure drop, causing a reduction in core heat exchange capability. Such heat exchangers also lack uniformity of air flow distribution through the passages in the heat exchanger core. In heat exchangers of this type as the air enters the air outlet manifolds, at low velocity, there is lack of uniformity of temperature distribution throughout the manifolds, thus developing temperature gradients between the manifolds and the heat exchanger core, causing thermal stresses, resulting in cracking, and splitting of the heat exchanger core.

Prior art heat exchangers are illustrated in the following U.S. Pat. Nos. 1,313,518 to Clark; 1,914,077 to Cluchey; 2,511,084 to Shaw, 2,819,045 to Pearse, Jr., et al; and 2,875,986 to Holm.

SUMMARY OF THE INVENTION

In accordance with the present invention, heat exchanger method and apparatus is provided in which cooling air flow is controlled to reduce air pressure drop in the air outlet manifolds, provide uniform air flow distribution through the heat exchanger core air passages, and uniformly distribute temperature throughout the air outlet manifolds, thereby increasing heat exchanger core heat exchange capability, and reducing core thermal stresses.

In the preferred embodiment of this invention, there is provided heat exchanger method and apparatus wherein cooling air entering the heat exchanger air outlet manifolds through openings is gradually changed in flow direction to reduce fluid pressure drop within the manifolds, and the flow of air in the manifolds is regulated to uniformly distribute air flow throughout the air passages of the heat exchanger core.

In another embodiment of the invention, air flowing from the manifold openings is rapidly moved in a circular direction within the manifolds, and directed out of the manifolds in an axial direction to uniformly distribute air temperature throughout the manifolds.

It will be seen that the heat exchanger method and apparatus of this invention provides greater heat exchange capability and reduced heat exchanger core cracking and splitting.

BRIEF DESCRIPTION OF THE DRAWINGS

For a more complete understanding of the invention, reference may be had to the accompanying drawings in which.

DETAILED DESCRIPTION OF THE PREFERRED EMBODIMENTS

Figure 1:
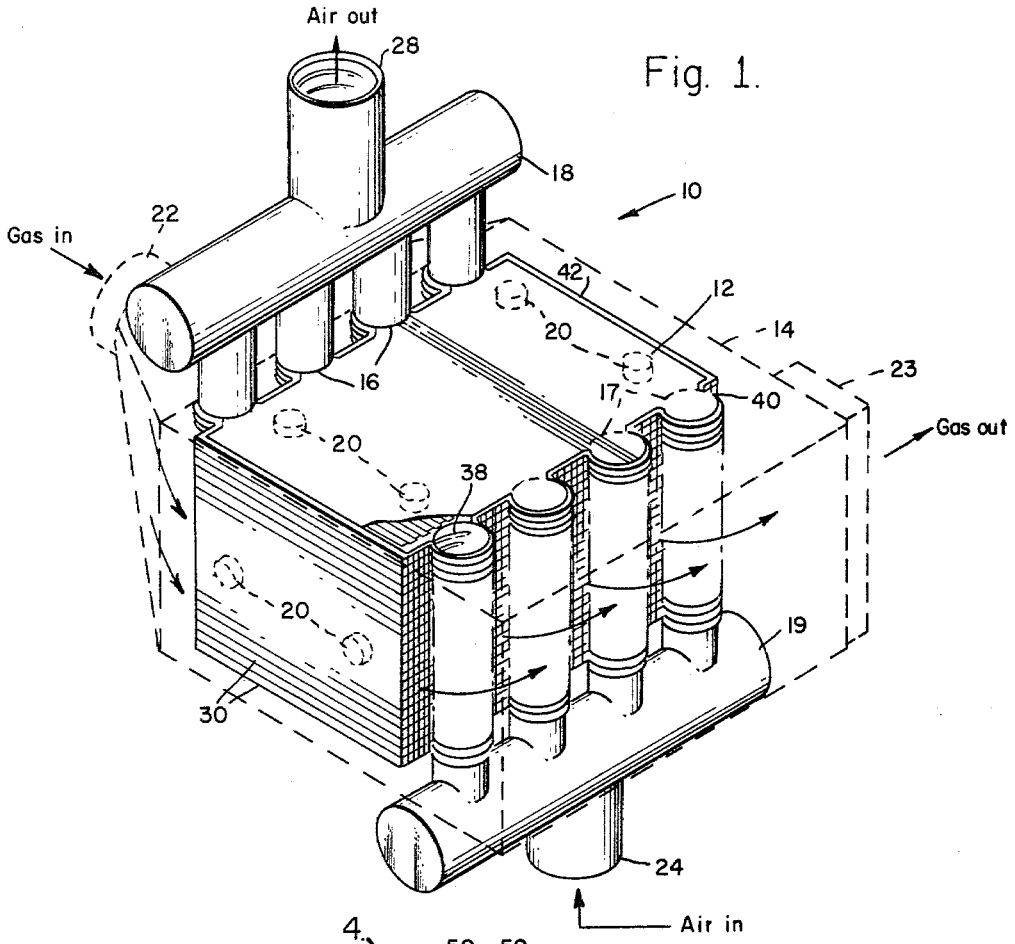
FIG. 1 is a perspective view of the heat exchanger incorporating the present invention.

Referring now to FIGS. 1-4, numeral 10 designates the heat exchanger embodying the present invention. Heat exchanger 10 has a core 12 enclosed within a housing 14. The core is provided with integral, formed tube manifolds 16, 17 on opposite sides of the central heat exchanger, connected respectively to headers 18, 19. Heat exchanger core 12 is supported within housing 14 by means of mounts 20. Housing 14 is provided with inlet and outlet passages 22 and 23 for passing a hot gas through the heat exchanger core 12 in intimate heat exchange relationship with air flowing between respective air outlet and inlet manifolds 16, 17.

Core section 12 includes a plurality of formed plates 30 sandwiched together and separated from each other by gas and air passages and containing layers of gas fins 32 and air fins 34, respectively. Formed plates 30 are provided with collars to develop the manifolds 16, 17 extending into the sandwiched structure and define strategically located openings 38 for passing air between the manifolds 16, 17 and air passages containing the air fins 34. Correspondingly, openings are provided at 40 for the passage of hot gases from the outside of core 12 to the gas passages containing the gas fins 32.

Plates 30 are each provided with an offset flange 42 extending about its periphery. Offset flange 42 is for the purpose of joining to a similar flange on the plate of the next layer in the stack so as to define a fluid passage having openings communicating therewith, i.e., when the fluid passage is an air stream opening communicating with manifolds 16 and 17, whereas for a gas stream the openings communicate with the outside of the core 12 at segments between adjacent manifolds 16 or 17. Such a segment is seen at 44 wherein gas openings 40 and the juncture of adjacent flanges 42 are shown in segment 44.

Figure 3:
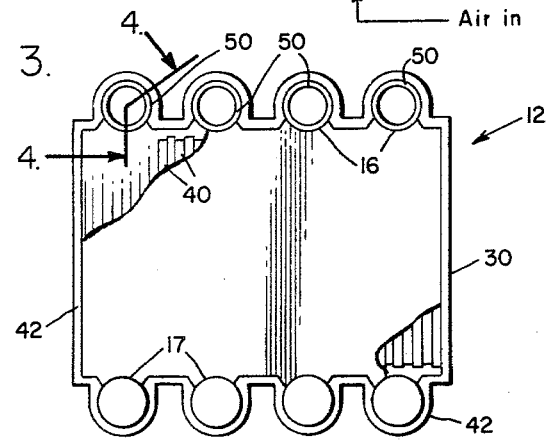
FIG. 3 is a plan view of the heat exchanger core of FIG. 1.
Figure 2:
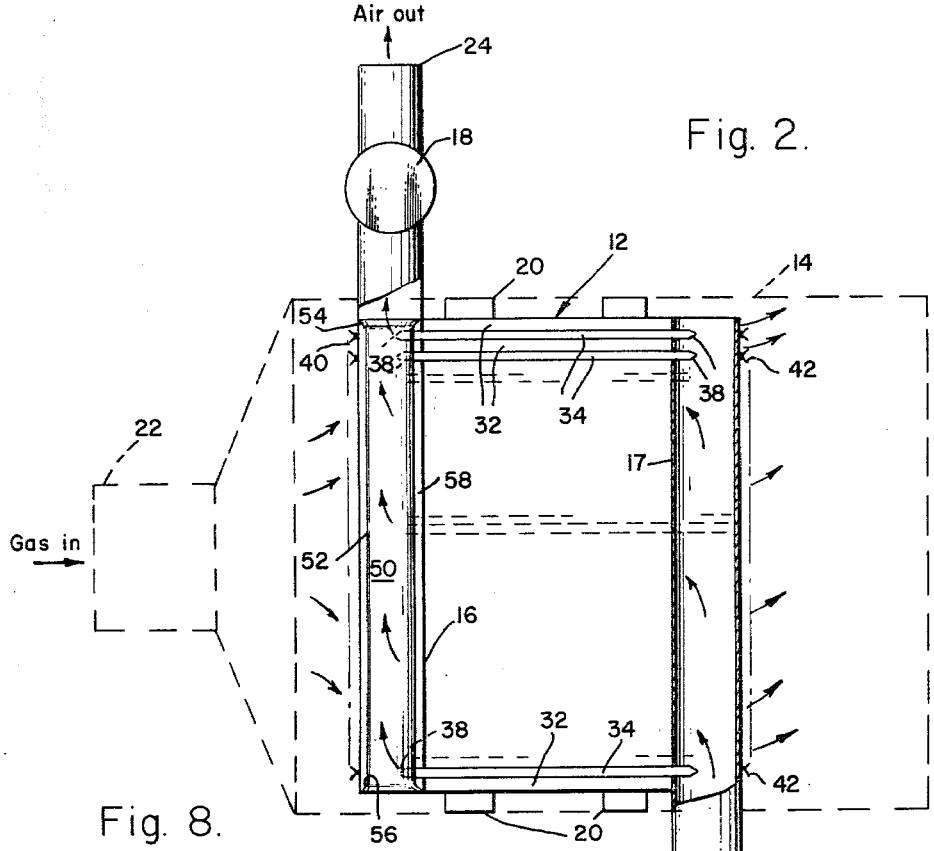
FIG. 2 is a partly broken away side elevation view of the heat exchanger of FIG. 1 illustrating the insert of one embodiment of the invention.
Figure 4:
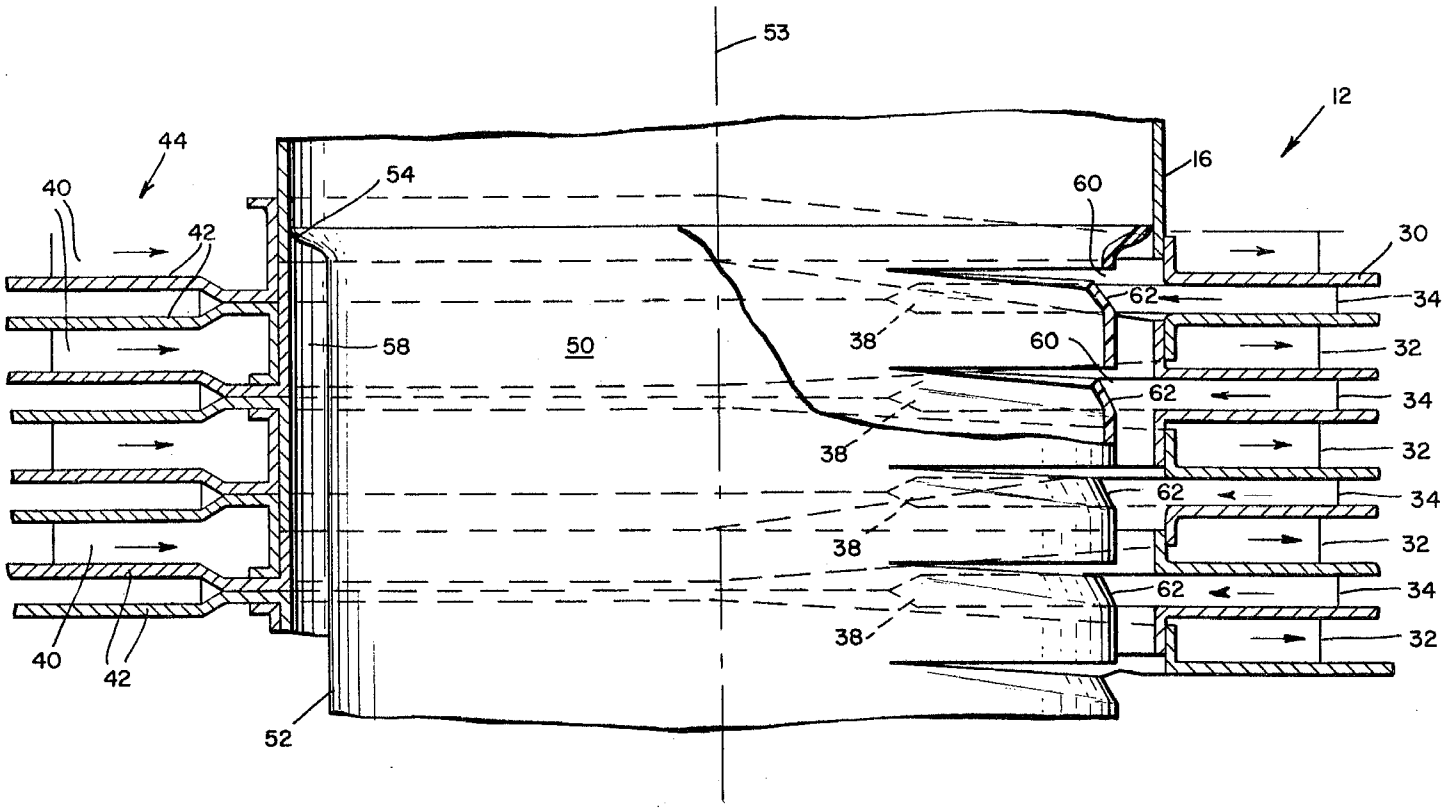
FIG. 4 is a cross section view along lines 4—4 of FIG. 3.
Figure 5:
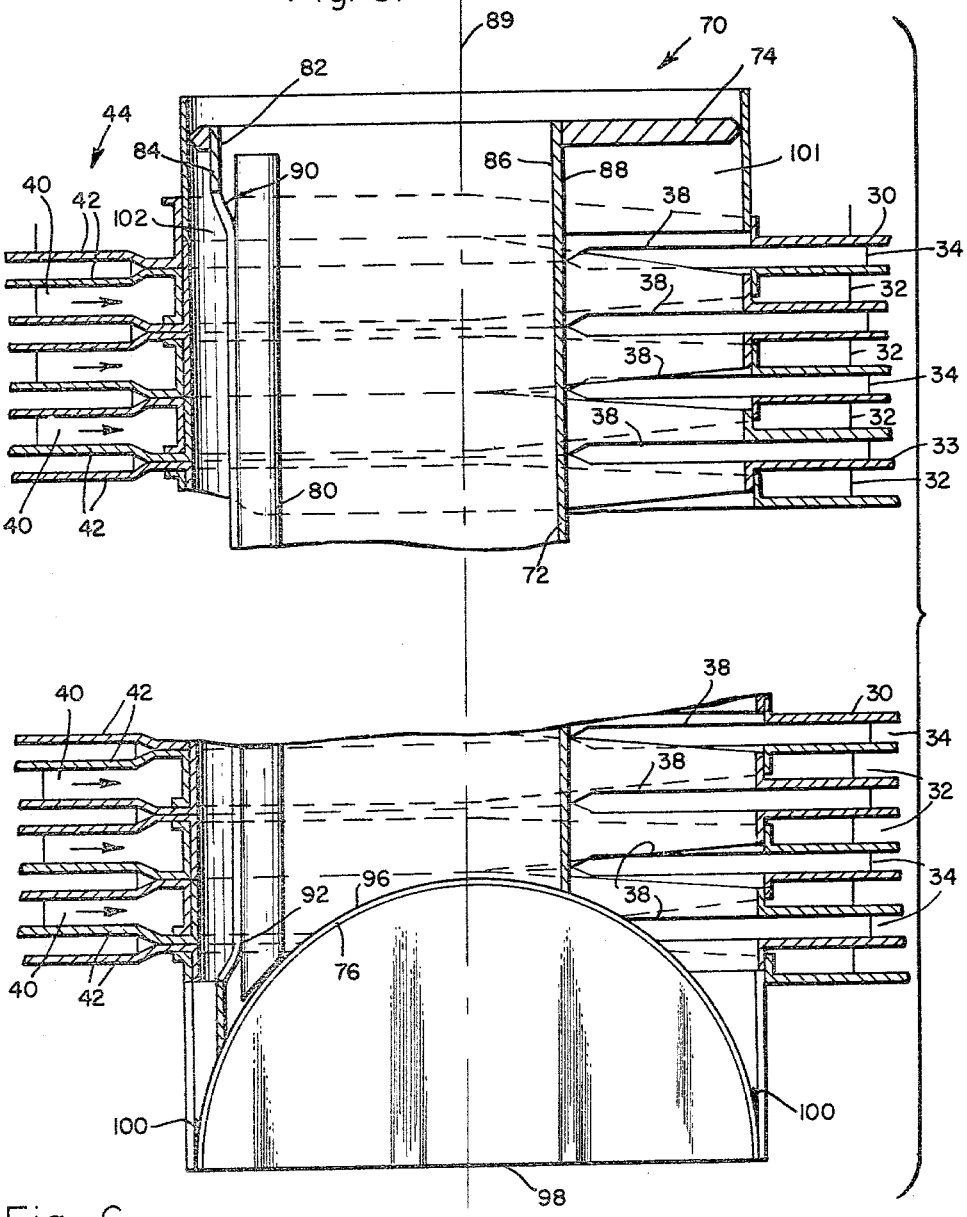
FIG. 5 is a cross section view showing details of the insert of another embodiment of the invention.
Figure 6:
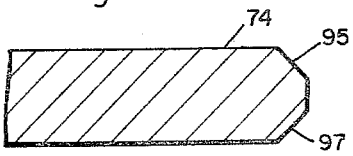
FIG. 6 is an enlargement of a portion of the insert of FIG. 5 showing details.

Reference is now made to FIGS. 2, 3, and 4, wherein details of one of the manifold inserts 50 of the present invention are illustrated. Each insert 50 is generally tubular in shape, with an intermediate cylindrical tube portion 52, and end, larger diameter portions 54, 56. Inserts 50 are adapted for positioning in manifolds 16 with their longitudinal axes 53 coincident with the longitudinal axes of the manifolds 16, and with upper and lower portions 54, 56 in engagement with the inner surfaces of the manifolds 16, in regions that are not provided with openings 38, as best shown in FIGS. 3 and 4. An annular chamber 58 is thus formed, communicating with openings 38. Inserts 50 are preferably fashioned from the same metal utilized to fashion core 12, such as stainless steel type 347.

Portions 52 of inserts 50 are initially provided with a plurality of peripheral, longitudinally equally spaced slots, of such lengths as to subtend angles substantially equal to the angles subtended by the openings 38, as measured at the respective longitudinal axes of inserts 50 and manifolds 16. Tube material adjacent the slots is then urged inwardly of the tube to form apertures 60 and adjacent louvers 62.

Inserts 50 are located within the air outlet manifolds 16 such that the louvers 62 are each disposed substantially opposite a manifold opening 38 and serve to gradually direct air flow from the openings 38 into the apertures 60 to substantially reduce the pressure drop of the air which would ordinarily merely abruptly dump into the air outlet manifolds of heat exchangers which are not provided with such inserts 50.

The size of each individual aperture 60 is adjustable and determined by the extent to which each adjacent louver 62 is inwardly urged within the insert 50. Adjustment of the individual aperture sizes with louvers 62 serves to regulate air flow through apertures 60 and adjacent openings 38, and provides for a more uniform air flow distribution throughout the heat exchanger core air passages. If, for example, more air tends to flow through a lower air passage of core 12 containing the fins 34 than air through an upper passage, FIG. 2, the size of aperture 60 adjacent opening 38 of the lower air passage can be made smaller than the size of the aperture 60 adjacent the opening of the upper air passage to provide substantially the same flow of air through both the upper and lower air passages. It will be appreciated that the sizes of all the apertures 60 can be thus similarly adjusted to provide substantially uniform air flow throughout all the air passages of core 12.

In operation, air enters header 19, through an inlet pipe 24, passes upward into manifolds 17 and then into the air flow passages in heat exchanger core 12. The air then flows through openings 38 into chamber 58, upwardly along louvers 62, through apertures 60 of inserts 50, and into manifolds 16, into header 18, and out through an outlet pipe 28. At the same time hot gas is flowing into housing 14 through the inlet duct 22, then through the gas flow passages containing the fins 32 sandwiched between the air flow passages of the heat exchanger core 12, and finally out of the housing 14 through the outlet duct 23.

Reference is now made to FIGS. 5–10, which illustrate another embodiment of the invention wherein there is provided other inserts 70 also disposable within the manifolds 16 of a heat exchanger such as the heat exchanger 10. Generally, each of the inserts 70 consists of an intermediate tubular portion 72, a top plate end portion 74, a bottom portion 76, and a pair of posts 78 and 80. Inserts 70 preferably are also fashioned from the same metal used to form core 12, or the like.

Intermediate portion 72 is in the shape of a segmented, cylindrical tube, having cylindrical inner and outer surface portions 82, 84, and flat inner and outer surface portions 86, 88. Intermediate tube portion 72 has a longitudinal axis 89 about which cylindrical inner and outer surface 82, 84 are symmetrically arranged. Cylindrical outer surface 84 has a radius which is less than the radius of the inner surface of air outlet manifold 16. Outer flat surface 38 subtends an angle substantially equal to the angles subtended by the openings 38. A pair of elongated, vertically aligned openings, or apertures, 90, 92 are provided through inner and outer surface portions 82, 84, directly opposite the flat inner surface 86.

Top plate 74 is circular in shape, and has a radius slightly less than the radius of inner surface of manifold 16, it being sufficient that plate 74 be capable of insertion within the manifold without binding. An opening 94 is provided through plate 74, which is in the shape of a segmented circle, of such configuration and size as to accommodate the upper portion of tube 72 to which the plate 74 is suitably fastened, as by brazing. Plate 74 has its outer edge campfered as at 95 and 97, best shown in FIG. 6. When assembled, the longitudinal axis 89 of segmented tube 72 passes substantially through the centers of plate 74 and segmented circular opening 94.

Bottom portion 76 is hemispherical in shape, and has an outside radius substantially equal to the radius of the inner surface of manifold 16. Portion 76 is secured as by brazing to the bottom of tube 72, which is so shaped in that region as to conform to the hemispherical top surface 96 of the bottom portion. When fastened to tube 72, the flat, bottom surface 98 of member 76 preferably should be substantially perpendicular to the axis 89 of the tube.

Figure 8:
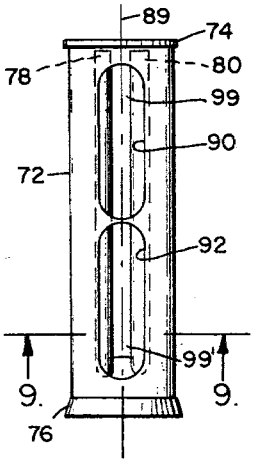
FIG. 8 is a side elevation view of the insert of FIG. 7.
Figure 10:
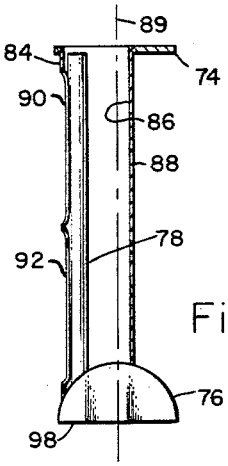
FIG. 10 is a cross section view along the lines 10—10 of FIG. 7.
Figure 9:
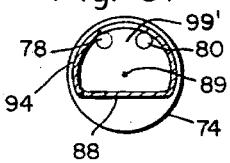
FIG. 9 is a cross section view along the lines 9—9 of FIG. 8.
Figure 7:
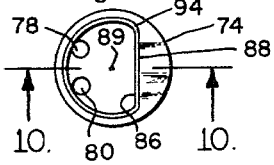
FIG. 7 is a plan view of the insert of FIG. 5.

Posts 78 and 80 are generally cylindrical in shape, and are secured, as by welding, at their surfaces, to tube 72, adjacent opposed corresponding vertical edges of the openings 90 and 92, substantially parallel to the longitudinal axis 89 of tube 72, best shown in FIG. 8. Posts 78 and 80, thus positioned, define openings or entrances 99 and 99', generally bell shaped in cross section, for smooth air flow into the insert 70.

When assembled, inserts 70 are each positioned within a manifold 16 so that axis 89 substantially coincides with the longitudinal axis of a manifold 16, flat outer surface 68 is directly opposed to openings 38, members 76 welded to the manifold inner surface, as at 100, and apertures 90, 92 remotely opposed to openings 38. Plates 74 are not welded or secured in any way to the inner surfaces of manifolds 16. When properly, relatively positioned, manifolds 16, and inserts 70, form an air chamber therebetween, having a segmented cylindrical portion 101, and a segmented annular portion 102.

In operation, air flowing from openings 38 first enters chamber portions 101, which are relatively large compared to portions 102. The air then moes circumferentially in both directions at relatively high velocity through chamber portions 102, entrances 99 and 99', and into tubular portions 72. After passing through the interiors of tubular portions 72 in an axial direction, the air flows through header 18 and out pipe 28. While flowing through chamber portions 102, the air maintains the temperature of the portions of manifolds 16 adjacent these chambers 102, close to the temperature of the air as it leaves openings 38. Such air flow thus provides a more uniformly distributed temperature throughout the manifolds 16, thus reducing thermal stresses between the manifolds and the heat exchanger core 12.

While specific embodiments of the invention have been illustrated and described, it is to be understood that they are provided by way of example only and that the invention is not to be contrued as being limited thereto but only by the scope of the following claims.

What we claim is:

1. The method of controlling air flow in a heat exchanger of the counter flow type having formed tube outlet manifolds with inserts having openings communicating with a plurality of air passages of the heat exchanger core, said method comprising the steps of:

introducing air into said heat exchanger core to flow through each of said passages toward said outlet manifolds;

causing substantially all of the air in each manifold to flow into the openings of said manifold insert for removal from said heat exchanger;

gradually changing the flow direction of air entering the manifold inserts around louvers provided at said openings for reducing fluid pressure drop within the manifolds; and controlling the relative sizes of said openings to overcome undesired air flow distribution by regulating air flow through each of said heat exchanger core passages and distributing air flow in a substantially uniform manner throughout the heat exchanger core.

* * * * *